US006914536B2

(12) United States Patent
Gratkowski

(10) Patent No.: US 6,914,536 B2
(45) Date of Patent: Jul. 5, 2005

(54) TIMING PAD

(76) Inventor: James J. Gratkowski, 1396 Biscayne Way, Marco Island, FL (US) 34145

( * ) Notice: Subject to any disclaimer, the term of this patent is extended or adjusted under 35 U.S.C. 154(b) by 183 days.

(21) Appl. No.: 10/611,751

(22) Filed: Jun. 30, 2003

(65) Prior Publication Data

US 2004/0264300 A1 Dec. 30, 2004

(51) Int. Cl.[7] ..... G08B 21/00
(52) U.S. Cl. ..... 340/666; 340/667; 200/85 R
(58) Field of Search ..... 340/666, 665, 340/667, 309.19, 309.3; 200/85 R, 85 A; 177/210 R, 210 C; 368/10, 89

(56) References Cited

U.S. PATENT DOCUMENTS 4,336,574 A 6/1982 Goodman
4,344,113 A 8/1982 Ditto et al.
4,845,323 A * 7/1989 Beggs ..... 200/85 R
4,913,248 A * 4/1990 Zakai ..... 177/210 C
5,141,065 A * 8/1992 Maxwell et al. ..... 177/210 R
5,307,250 A 4/1994 Pearson
5,575,553 A 11/1996 Tipton
5,594,419 A * 1/1997 Lo ..... 340/568.1
5,644,298 A 7/1997 Brooks et al.
6,062,126 A 5/2000 Johnson et al.
6,252,494 B1 6/2001 Howell
6,504,481 B2 1/2003 Teller
6,646,556 B1 * 11/2003 Smith et al. ..... 340/573.1
6,707,386 B1 * 3/2004 Pruisner ..... 340/665

* cited by examiner

*Primary Examiner*—John Tweel, Jr.
(74) *Attorney, Agent, or Firm*—The Livingston Firm

(57) ABSTRACT

A timing pad for determining the amount of time used when consuming a beverage. The user places an object, such as a mug, glass, or bottle, onto the weight sensor area (2). The user then presses the reset button (4). The reset button (4) is connected to an internally located replaceable battery (14), which supplies power to the timer (7) and the weight sensor (8). The timer (7) and the weight sensor (8) are connected electrically to permit the timer (7) to begin running when user removes the object from the weight sensor area (2). When user places the object back onto the weight sensor area (2), the stop watch-like timer (7) stops running. The user may now remove the object to read his or her beverage consuming time in the timer display (1). The timing pad is particularly suited for beverage consumers desiring to know the precise amount of time it took to consume a beverage in comparison to others.

5 Claims, 2 Drawing Sheets

TIMING PAD

BACKGROUND OF THE INVENTION

This invention relates to timers, more specifically, a timing pad where a weight sensor begins the timer when weight is removed from the pad and stops the timer when weight is returned.

When drinking with friends, contests sometimes emerge where one person believes that he or she can drink a beverage quicker than another. Typically the contest begins with someone yelling 'go' and commences with the first slamming of a glass or bottle onto a table. When such an event arises, the most common method of determining the winner in such a contest is by visual means. Simply watching the contest, however, has many drawbacks, including 1) having one person "sit out" of the contest by being forced to be the lookout, 2) the lookout having to keep close watch over all the participants in the contest, however numerous, 3) the lookout not being able to discern the fastest drinker because several participants finished at approximately the same time, and 4) disagreements arising as to who was the true victor.

But what if the lookout had a means of precisely recording the time it takes for someone to finish her drink? Wouldn't that make it easier to discern who was the true victor? In this situation, although the lookout would be able to record a precise time as to when a participant finishes his beverage, the lookout can only perform this function as to one participant only. A contest would not function using this method of timing because each participant having his or her own lookout timer would be the only way of determining a victor. Thus, although timing participants engaged in such contests is a good idea in theory, it is simply impractical in practice.

Thus, the present invention helps to alleviate the need for cautiously watching other participants and having many people serve as lookouts by having a pad which serves as a timer. Since each participant would have his or her own timing pad, the need for lookouts is eliminated and each participant will be able to be aware of the precise amount of time it took to finish the beverage.

The prior art includes the following United States patents:

| U.S. Pat. No. | Inventor | Filing Date | Issue Date |
|---|---|---|---|
| 6,252,494 B1 | Howell | Jan. 28, 2000 | Jun. 26, 2001 |
| 5,644,298 | Brooks et al. | Sep. 28, 1995 | Jul. 1, 1997 |
| 4,336,574 | Goodman | Aug. 19, 1980 | Jun. 22, 1982 |
| 6,504,481 B2 | Teller | Dec. 8, 2000 | Jan. 7, 2003 |
| 4,334,113 | Ditto et al. | Dec. 18, 1979 | Aug. 10, 1982 |
| 5,307,250 | Pearson | May 4, 1993 | Apr. 26, 1994 |
| 5,575,553 | Tipton | Jun. 23, 1995 | Nov. 19, 1996 |
| 6,026,126 | Johnson et al. | Feb. 5, 1999 | May 16, 2000 |

None of the above patents or publications disclose a timing pad used in conjunction with the timing of drinking of a liquid.

SUMMARY OF THE INVENTION

The primary object of the present invention is to provide a timer pad for consumers of beverages to monitor the amount of time it takes to consume an entire beverage.

A further object of the present invention is the timing pad can be used for other purposes, such as allowing a mixture to set for cooking.

Another object of the present invention to is to provide an advertising medium for beverage companies, bars, restaurants, and the like.

The present invention fulfills the above and other objects by providing a timing pad made of compressible materials, having a stop watch-like timer and weight sensor therein. The weight sensor would activate the timer when weight is removed from the pad and stop when weight is replaced onto the pad. The timer would reset upon pressing the reset button on the side of the pad.

The above and other objects, features, and advantages of the present invention should become even more readily apparent to those skilled in the art upon a reading of the following detailed description in conjunction with the drawings wherein there is shown and described illustrative embodiments of the invention.

BRIEF DESCRIPTION OF DRAWINGS

This invention is described by appended claims in relation to a description of a preferred embodiment with reference to the following drawings which are explained briefly as follows:

DESCRIPTION OF PREFERRED EMBODIMENT

Listed numerically below with reference to the drawings are terms used to describe features of this invention. These terms and numbers assigned to them designate the same features throughout this description.

| | |
|---|---|
| 1. | timer display |
| 2. | weight sensor area |
| 3. | perimeter |
| 4. | reset button |
| 5. | side |
| 6. | top section |
| 7. | stop watch-like timer |
| 8. | weight sensor |
| 9. | bottom section |
| 10. | advertisement |
| 11. | front side |
| 12. | weight sensor to timer connector |
| 13. | battery to timer connector |
| 14. | battery |
| 15. | reset button to battery connector |
| 16. | battery to weight sensor connector |
| 17. | battery compartment cover |
| 18. | battery compartment security device |
| 19. | battery compartment |
| 20. | beer mug |

Figure 1:
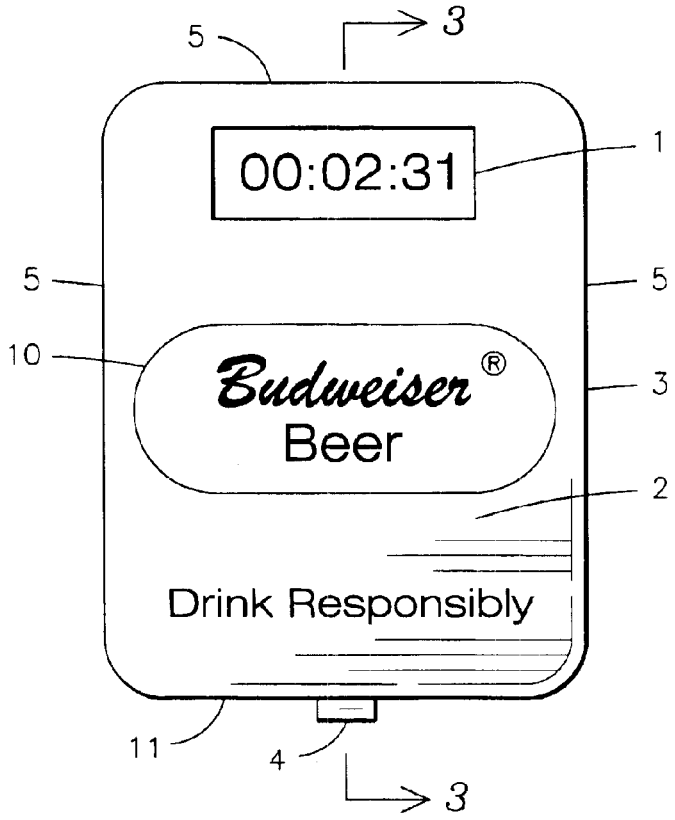
FIG. 1 is a top view of an embodiment of the present invention, with a hypothetical advertisement placed thereon.
Figure 2:
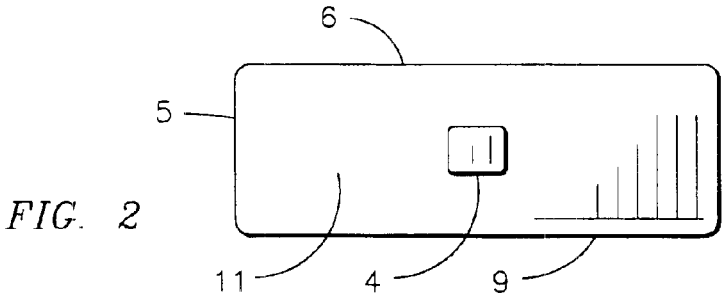
FIG. 2 is a side view of the embodiment of FIG. 1.

With reference to FIGS. 1 and 2, a top view of the timing pad is shown with hypothetical advertisement 10 placed thereon. The timing pad has a top section 6, bottom section 9 and a perimeter 3 comprising a plurality of sides 5. Objects, such as mugs, glasses, and bottles, can be placed upon the timing pad on the weight sensor area 2. A user presses reset button 4 to reset the timer display 1 to zero before commencing. A perimeter 3 surrounds the weight sensor area 2.

In FIG. 2, a side view of the front side 11 of the timing pad is shown. The reset button 4 is located in the front side 11 which preferably would be made of soft material, such as neoprene rubber.

Figure 3:
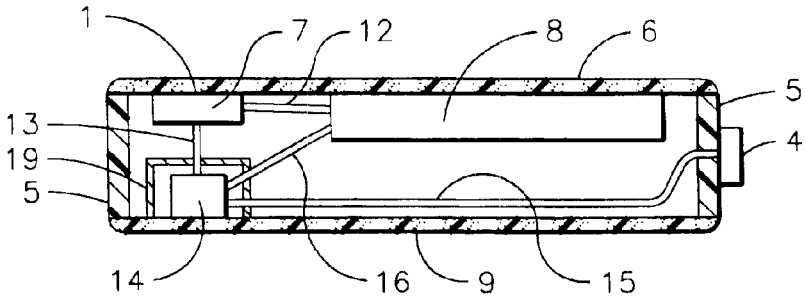
FIG. 3 is a cross sectional view along lines 3—3 of the embodiment of FIG. 1.

In FIG. 3, the weight sensor 8 is located between the top section 6 and the bottom section 9, both sections preferably made of soft rubber. The stop watch-like timer 7 is located below the top section 6. The battery 14 is placed in the battery compartment 19. The battery compartment 19 is located above the bottom section 9. The sides 5 connect the top section 6 to the bottom section 9. The reset button 4 is connected electrically to the battery 14 by the reset button to battery connector 15. In turn the battery 14 is connected electrically to the timer 7 by the battery to timer connector 13. The battery 14 is also connected electrically to the weight sensor 8 by the battery to weight sensor connector 16. The weight sensor 8 is connected to the timer 7 by the weight sensor to timer connector 12.

Figure 4:
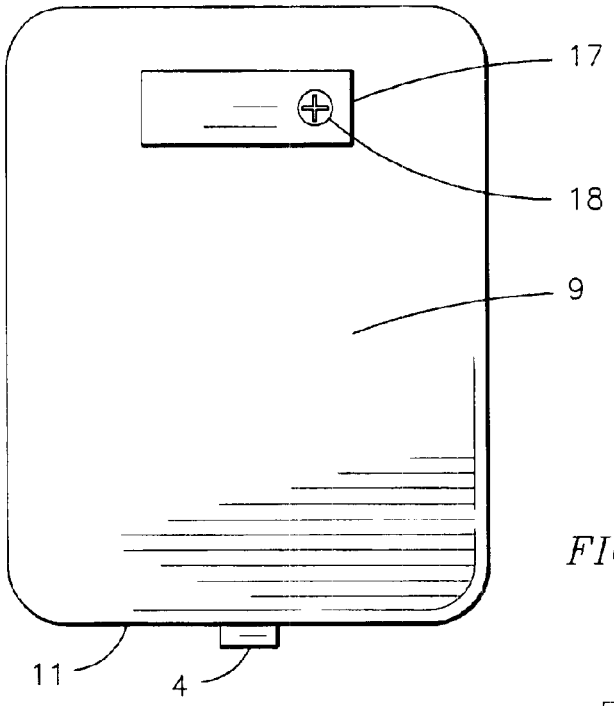
FIG. 4 is a bottom view of the embodiment of FIG. 1.

In FIG. 4, a bottom view of the timing pad is shown. The battery compartment cover 17 is shown with a battery compartment cover security device 18, which preferably would be a screw.

Figure 5:
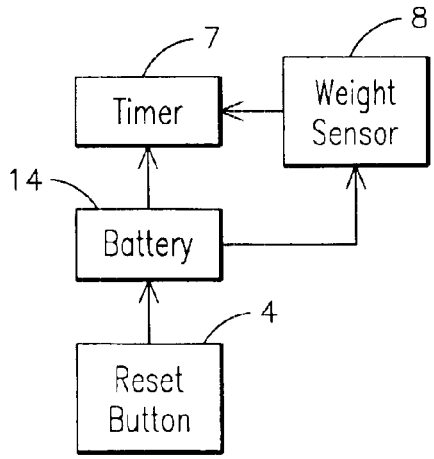
FIG. 5 is a flow chart showing the operation of FIG. 1.

In FIG. 5, a flow chart of the operation of the invention is shown. The reset button 4 is pressed to momentarily interrupt the circuit in order to reset the timer 7 and the weight sensor 8. The battery 14 supplies power to the timer 7 and the weight sensor 8. When weight is removed from the weight sensor 8, the weight sensor 8 will start the timer 7. When weight is reapplied to the weight sensor 8, the weight sensor will stop the timer 7.

Figure 6:
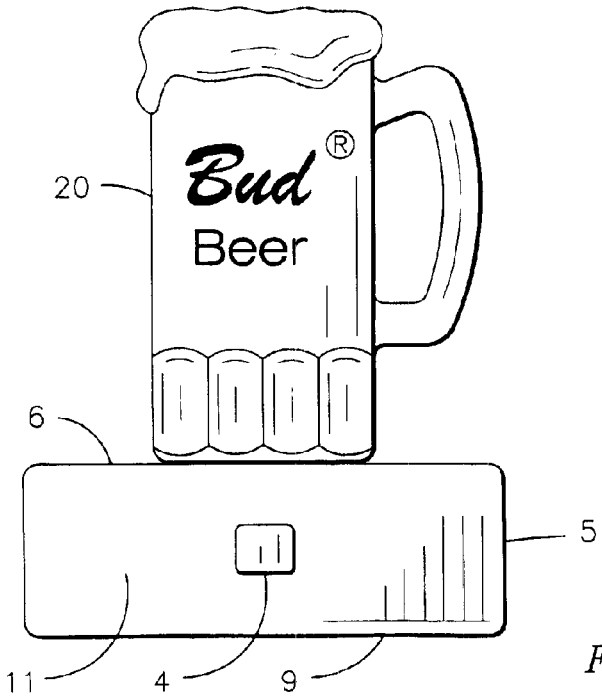
FIG. 6 is a side view of the front side of the embodiment of FIG. 1, with a mug of beer placed thereon.

In FIG. 6, a side view of the front side 11 of the invention is shown with a mug of beer 20 that would supply the weight on the timing pad before commencing operation as described above.

The timing pad should be of sufficient shape and size as to accommodate various sizes of containers, including, but not limited to, mugs, glasses, bottles, and bowls. The top section 6 should be translucent enough as to permit easy visualization of the timer display 1. Finally, the sides 5 should be resilient, yet have sufficient rigidity as to withstand pressure exerted from users who may forcefully slam down mugs, glasses, bottles, etc.

The use of the present invention allows users to time how long it takes for her to consume a beverage. In addition, it permits easy determination of a victor in drinking contests.

It is to be understood that while a certain form of the invention is illustrated, it is not to be limited to the specific form or arrangement of parts herein described and shown. It will be apparent to those skilled in the art that various changes may be made without departing from the scope of the invention and the invention is not to be considered limited to what is shown and described in the specification and drawings.

I claim:

1. A timing pad comprising:

a compressible material of a predetermined shape having a substantially planar bottom, a top, and a perimeter;

an external reset button on the side electrically connected to an internal battery located above the bottom;

an internal weight sensor located between the top and the bottom electrically connected to said internal battery;

an internal stop watch-like timer in the upper portion visible from the top electrically connected to said internal battery and said weight sensor; and an internal weight sensor area below the top.

2. A timing pad according to claim 1, wherein said weight sensor activates said timer when weight is removed from said weight sensor area.

3. A timing pad according to claim 1, wherein said weight sensor stops said timer when weight is re-applied to said weight sensor area.

4. A timing pad according to claim 1, wherein said reset button resets said timer to zero when pressed.

5. A timing pad according to claim 1, wherein said battery is replaceable.

* * * * *